US005905515A

United States Patent [19]

Yoshimura

[11] Patent Number: 5,905,515

[45] Date of Patent: May 18, 1999

[54] WATER-REPELLENT FILM FOR A NOZZLE PLATE OF AN INK EJECTING DEVICE

[75] Inventor: Manabu Yoshimura, Nagoya, Japan

[73] Assignee: Brother Kogyo Kabushiki Kaisha, Nagoya, Japan

[21] Appl. No.: 08/521,452

[22] Filed: Aug. 30, 1995

[30] Foreign Application Priority Data

Sep. 1, 1994 [JP] Japan ..... 6-208496

[51] Int. Cl.[6] ..... B41J 2/135

[52] U.S. Cl. ..... 347/45; 347/47

[58] Field of Search ..... 219/121.7, 121.71; 347/47, 45, 46; 346/135.1; 430/945, 527, 631

[56] References Cited

U.S. PATENT DOCUMENTS 5,410,005 4/1995 Nemoto et al. ..... 526/245
5,653,901 8/1997 Yoshimura ..... 219/121.71

FOREIGN PATENT DOCUMENTS 61-19148 12/1986 Japan .
61-291148 12/1986 Japan .
61-291149 12/1986 Japan .
62-202743 9/1987 Japan ..... 347/45

*Primary Examiner*—Benjamin R. Fuller
*Assistant Examiner*—Christina Annick
*Attorney, Agent, or Firm*—Oliff & Berridge, PLC

[57] ABSTRACT

A water-repellent film includes a fluorocarbon resin and a surface active agent. The surface acting agent serves as an antistatic agent. The water-repellent films is applied to a nozzle plate substrate by spray coating. Nozzles are then formed by drilling with a laser beam emitted from an excimer laser device. At this time, although the nozzle plate substrate and the antistatic film are processed at the same time, the laser drilling is smoothly performed without any trouble because the antistatic agent of the water-repellant film is a surface active agent. Thereafter, the nozzle plate substrate is attached, via an adhesive, to an actuator member in which ink paths are formed. Since the antistatic agent is mixed in the water-repellent film, the antistatic effect does not deteriorate due to wiping the nozzle surface to remove ink dust and the like from the nozzle surface.

10 Claims, 3 Drawing Sheets

Fig.3

| Factor of Reduction M | Energy Density $J/cm^2$ | Maximum Processable Size mm x mm | Etching Speed $\mu m$/pulse | Process-ing Speed | Material of Work to be Processed |
|---|---|---|---|---|---|
| 3 | 0.8 | 2.0 x 6.0 | 0.20 | 480 | Polyimide |
| 10 | 9.0 | 0.6 x 1.8 | 0.10 | 22 | Ceramics, Metal, Glass |

WATER-REPELLENT FILM FOR A NOZZLE PLATE OF AN INK EJECTING DEVICE

BACKGROUND OF THE INVENTION

1. Field of the Invention

This invention relates to an ink ejecting device in which the surface of a nozzle portion is coated with a water-repellent film and the nozzle surface is further treated to prevent the nozzle surface from becoming electrically charged.

2. Description of the Related Art

Generally, in an ink ejecting device which ejects ink to form an image, a water-repellent film is formed on the nozzle surface to prevent the nozzle from being clogged with, for example, drops of ink adhering to the circumference of the ink-ejecting nozzle. Further, an antistatic treatment is applied to the nozzle surface so that dust and the like will not attach to the nozzle surface.

Known antistatic treatments include a method in which, as described in Japanese Patent Laid-open Nos. 61-291148 and 61-291149, a metallic conductive filler is mixed into the nozzle substrate resin which is used to form the nozzle plate. This nozzle plate is used in an ink ejecting device having a water-repellent film formed on the nozzle surface. Alternately, the metallic conductive filler is mixed in the water-repellent film, and the nozzle substrate resin or the water-repellent film is grounded. Other known methods include a method in which a surface active agent is applied to the water-repellent film and a method in which a metallic thin film is formed on the water-repellent film.

With the recent increase in the packaging density in ink ejecting devices, nozzles having a diameter of 20 $\mu$m–50 $\mu$m are formed in a nozzle plate at a small pitch (or center-to-center interval) by excimer laser beam drilling. In such processing, if the water-repellent film is formed after the nozzles have been formed, the nozzles become clogged with the water-repellent film. Therefore, the nozzles must be formed after the water-repellent film has been formed.

However, in the above-described known methods for applying the antistatic treatments to the ink ejecting devices, when a metallic conductive filler is mixed into the nozzle substrate resin or the water-repellent film, the metallic conductive filler cannot be processed by the excimer laser beam. Thus, it becomes impossible to drill fine nozzles, Also, in the method in which a metallic film is formed on a water-repellent film, it becomes much more difficult to form the nozzles with the excimer laser beam.

On the other hand, if the metallic thin film is formed on, or a surface active agent is applied to, the nozzle surface so that the thin metallic film or surface active agent layer does not affect the excimer laser beam processing, the thin film or the applied surface active agent layer wears away from or peels off of the nozzle surface due to wiping operations to remove ink, dust or the like from the nozzle surface. Thus, this method has a problem that the useful lifetime of the antistatic treatment is too short.

SUMMARY OF THE INVENTION

This invention overcomes the above-mentioned problems by providing an ink ejecting device which allows nozzle fabrication with an excimer laser beam to be performed with good processability and which prevents deterioration of the antistatic treatment provided on the nozzle surface.

In particular, in this invention, the ink ejecting device has a water-repellent film formed on the nozzle surface of a nozzle plate. An antistatic treatment is applied to the nozzle surface using a surface active agent which produces an antistatic effect and which is mixed into the water-repellent film.

In the ink ejecting device of this invention, formation of a static electric charge on the nozzle surface is prevented. Hence, due to mixing the surface active agent producing the antistatic effect into the water-repellent film, dust and the like does not attach to the nozzle surface.

BRIEF DESCRIPTION OF THE DRAWINGS

A preferred embodiment of this invention will be described in detail, with reference to the following figures, wherein:

FIG. 3 is a table comparing the necessary operating conditions when excimer laser drilling of the nozzle plate of the preferred embodiment and a known nozzle plate structure.

DETAILED DESCRIPTION OF THE PREFERRED EMBODIMENT

Figure 1:
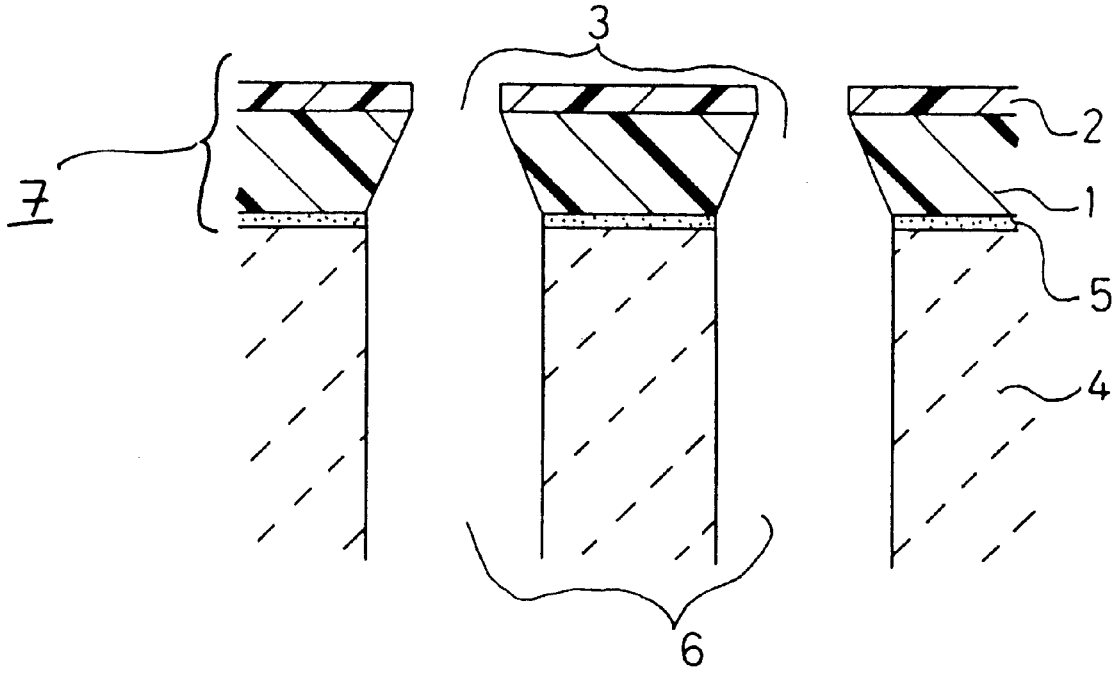
FIG. 1 is a cross-sectional view of a portion of the nozzle plate of an ink ejecting device of a preferred embodiment of this invention.

FIG. 1 shows an enlarged cross-sectional view of a portion of a nozzle plate and an actuator of an ink ejecting device which has been treated with an antistatic treatment according to this invention. The nozzle plate 7 comprises a nozzle plate substrate 1 which is coated with a water-repellent film 2. The water-repellant film 2 includes an antistatic agent which has been mixed into the water-repellent film 2. The other side of the nozzle plate is coated with an adhesive 5.

A number of ink paths or ink channels 6 are formed in the actuator member 4. Likewise, a similar number of nozzles 3 are formed in the nozzle plate 7, which connect the ink channels 6 to the outside of the ink ejecting device. Thus, ink carried in the ink channels 6 is ejected through the nozzles 3.

To form the nozzles 3 in the nozzle plate 7, the water-repellent film 2, which is formed of a fluorocarbon resin, is first mixed with a surface active agent. The resin/surface active agent mixture is applied to the nozzle plate substrate 1 by spray coating. In the preferred embodiment, a polyimide resin is used for the nozzle plate substrate 1. In the preferred embodiment, the surface active agent is, for example, one or more of a polyoxyethylene alkyl amine, a polyoxyethylene alkyl amide, a polyoxyethylene alkyl ether, or a polyoxyethylene alkyl phenyl ether. In general, the surface active agent is non-ionic.

Figure 2:
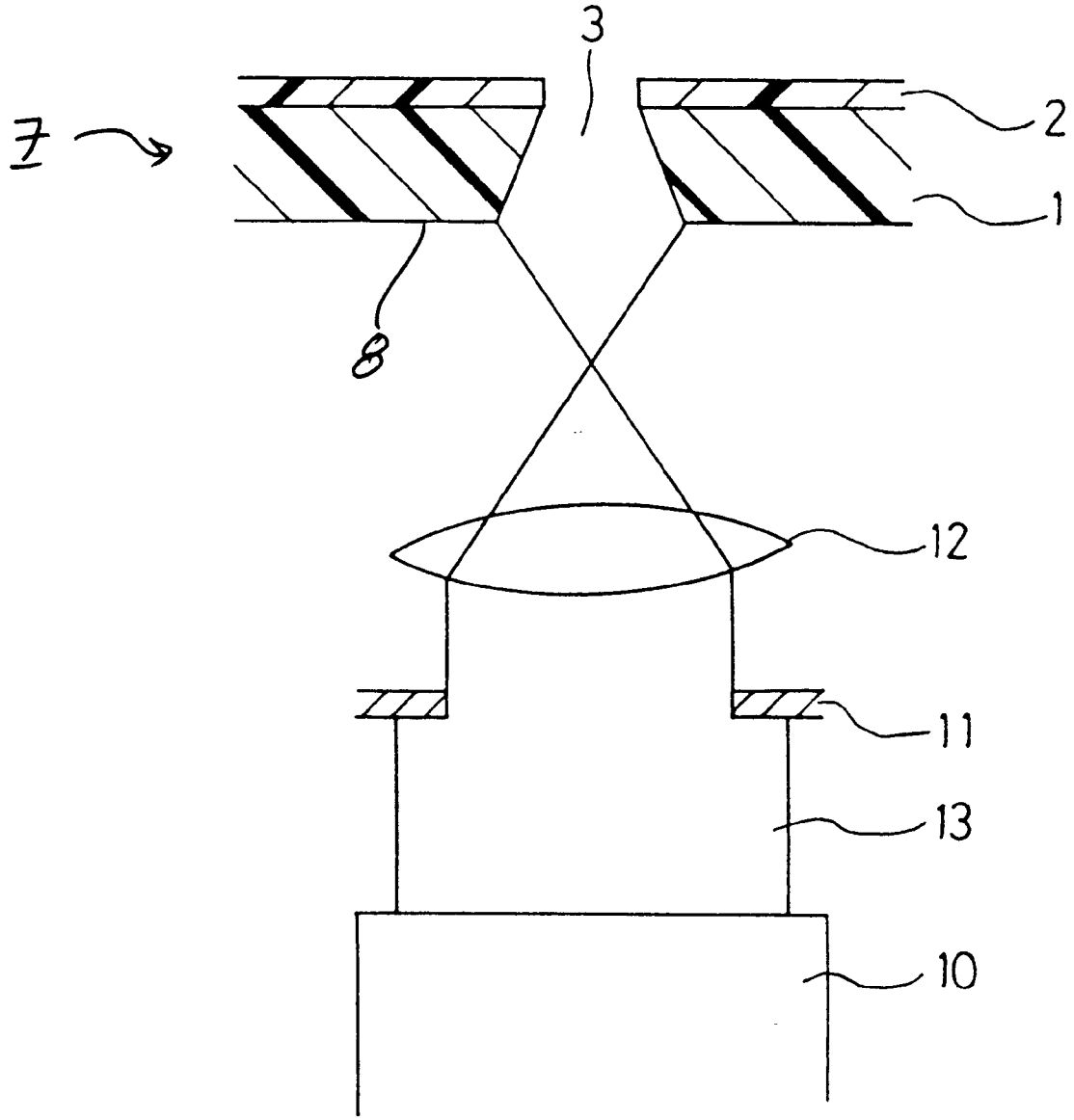
FIG. 2 is a schematic view of the fabrication of a nozzle in the nozzle plate in the preferred embodiment.

Then, as shown in FIG. 2, a laser beam 13 is emitted from an excimer laser device 10. The laser beam 13 passes through a mask 11 to impart a desired shape onto the laser beam nozzle to be fabricated onto the laser beam 13. Thereafter, the laser beam 13 is focused by a lens 12 onto a surface 8 of the nozzle plate substrate 1. The laser beam 13 forms the nozzle 3 in the nozzle plate substrate 1. Once the laser beam 13 drills through the nozzle plate substrate 1, it is applied to and drills through the water-repellant film 2 formed on the nozzle plate substrate 1 to form the nozzle 3 in the water-repellant film 2. Thus, the nozzle 3 having the desired shape is drilled into the nozzle plate 7.

Although, at this time, the nozzle plate substrate 1 and the water-repellent film 2 are processed at the same time, the nozzle 3 is smoothly formed without any trouble during the laser drilling because the antistatic agent mixed in the water-repellent film 2 is a surface active agent. Then, the nozzle plate substrate 1 of the nozzle plate 7 is attached to the actuator member 4 by the adhesive 5.

FIG. 3 compares the processability when forming the nozzles 3 using excimer laser beam drilling of the polyimide nozzle plate substrate 1 and a conventional metallic nozzle plate. As apparent from the table of FIG. 3, an energy density of the excimer laser beam of $0.8J/cm^2$ is sufficient to form the nozzle 3 in the polyimide nozzle plate substrate 1 of the nozzle plate 7. Thus, the required reduction of the laser beam 13 when it is focused by the lens 12 is 3.

Accordingly, for an excimer laser beam 13 having original dimensions of 6.0 mm×18.0 mm, the maximum area of the nozzle plate 7 processable at one time by the excimer laser beam is 2.0 mm×6.0 mm. The etching speed of the polyimide plate 7 by the excimer laser beam having an energy density of $0.8J/cm^2$ is 0.20 $\mu$m/pulse. The excimer laser beam 13 is pulsed at a rate of 200 pulses/sec. Thus, the total processing speed of the laser beam when forming the nozzles 3 in the polyimide nozzle plate 7 is 0.20 $\mu$m/pulse·2.0 mm·6.0 mm·200 pulses/sec=480$\mu$m·$mm^2$/sec.

On the other hand, in processing the conventional metallic nozzle plate, the required energy density of the excimer laser beam is $9.0J/cm^2$. Thus, the required reduction factor for focusing the excimer laser beam onto the conventional metallic nozzle plate by the lens 12 is 10. Accordingly, for the 6.0 mm×18.0 mm excimer laser beam 13, the maximum area of the conventional metallic nozzle plate processable at one time by the excimer laser beam is 0.6 mm×1.8 mm. Since the etching speed of the conventional metallic nozzle plate by the laser beam 13 having an energy density of $9.0J/cm^2$ is 0.10 $\mu$m/pulse, the total processing speed of the laser beam 13 when forming the nozzles in the conventional metallic nozzle plate is 0.10 $\mu$m/pulse·0.6 mm·1.8 mm·200 pulses/sec=22 $\mu$m·$mm^2$/sec.

Thus, a much higher energy density is required to process the conventional metallic nozzle plate with the excimer laser beam 13 than is required to process the polyimide nozzle plate 7. Further, the processable area is smaller and the processing speed of the conventional metallic nozzle plate is much slower compared to the polyimide nozzle plate 7. In the preferred embodiment, since a surface active agent is mixed in the water-repellent film 2, there is no problem with the processability of the polyimide nozzle plate 7 using the excimer laser beam 13.

The surface resistance value of the polyimide resin used for the nozzle plate substrate 1 is around $10^{15}\Omega$ and its discharge half-life is infinite. However, due to the water-repellent film 2 into which the antistatic agent is mixed, the resistance value of the nozzle surface of the nozzle plate 7 is $10^{15}\Omega$ and the discharge half-life is several seconds. Therefore, a good antistatic effect is obtained. Further, since the antistatic agent is mixed into the water-repellent film 2 formed of a fluorocarbon resin, deterioration of the antistatic effect by wiping to remove ink, dust and the like from the nozzle surface is prevented. Thus, the life of the antistatic effect is prolonged.

In the ink ejecting device of this invention, a surface active agent producing an antistatic effect is mixed into the water-repellent film. Therefore, the nozzle surface is prevented from becoming electrically charged. Hence, dust and the like does not become attached to the nozzle surface. Further, since the antistatic agent is a surface active agent, fine nozzle formation can be performed without any adverse effect being caused by the antistatic agent.

This invention is not limited to the preferred embodiment described above. Rather, various changes may be made without departing the spirit of this invention. For example, in the preferred embodiment, the nozzle plate substrate 1 is formed of a polyimide resin. However, a polysulfone resin or the like may be used to form the nozzle plate substrate 1. Additionally, in the preferred embodiment, the water-repellent film 2 was applied by spray coating. However, it may be applied by spin coating, dip coating or the like.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink ejecting device, comprising:

an actuator member having a plurality of ink channels; and a nozzle plate having a plurality of nozzles and comprising:

a nozzle plate substrate having a surface, and a film coated on the surface of the nozzle plate substrate, the film comprising a non-ionic surface active agent selected from the group consisting of polyoxyethylene alkyl amine, polyoxyethylene alkyl amide, polyoxyethylene alkyl ether and polyoxyethylene alkyl phenyl ether mixed into a water-repellent material that is a fluorocarbon resin prior to coating, wherein the non-ionic surface active agent prevents a surface of the film from becoming electrically charged.

2. The ink ejecting device according to claim 1, wherein the surface of the nozzle plate substrate is a nozzle surface, and wherein the film is coated over the nozzle surface so as to cover all of the nozzle surface.

3. A nozzle plate, comprising:

a nozzle plate substrate having a surface;

a film coated on the surface of the nozzle plate substrate; and a plurality of nozzles formed in the nozzle plate and the film;

wherein the film comprises a non-ionic surface active agent selected from the group consisting of polyoxyethylene alkyl amine, polyoxyethylene alkyl amide, polyoxyethylene alkyl ether and polyoxyethylene alkyl phenyl ether mixed into a water-repellent material that is a fluorocarbon resin prior to coating, wherein the non-ionic surface active agent prevents a surface of the film from becoming electrically charged.

4. The nozzle plate according to claim 3, wherein the nozzle plate is incorporated into an ink ejecting device, the ink ejecting device comprising an actuator member having a plurality channels.

5. The nozzle plate according to claim 3, wherein the surface of the nozzle plate substrate is a nozzle surface, and wherein the film is coated over the nozzle surface so as to cover all of the nozzle surface.

6. A method for forming nozzles in a nozzle plate, comprising:

providing a nozzle plate substrate having a first surface and a second surface;

forming a mixture of a water-repellent material that is a fluorocarbon resin and a surface active agent selected from the group consisting of polyoxyethylene alkyl amine, polyoxyethylene alkyl amide, polyoxyethylene alkyl ether and polyoxyethylene alkyl phenyl ether;

coating a film of the mixture on the first surface of the nozzle plate substrate; and forming a plurality of nozzles in the nozzle plate and the film;

wherein the surface active agent prevents a surface of the film from becoming electrically charged.

7. The method according to claim 6, further comprising:

providing an actuator member having a plurality of ink channels; and attaching the nozzle plate to the actuator member such that each of the nozzles is connected to a corresponding one of the plurality of ink channels.

8. The method according to claim 6, wherein the surface active agent is non-ionic.

9. The method according to claim 6, wherein the step of forming the plurality of nozzles comprises laser beam drilling the second surface of the nozzle plate substrate after the film has been coated on the first surface of the nozzle plate substrate.

10. The method according to claim 6, wherein the step of coating the film on the first surface of the nozzle plate substrate comprises coating the film over the first surface so as to cover all of the first surface, wherein the first surface is a nozzle surface.

* * * * *